United States Patent [19]

Polus et al.

[11] Patent Number: 4,763,426

[45] Date of Patent: Aug. 16, 1988

[54] SPORT SHOE WITH PNEUMATIC INFLATING DEVICE

[76] Inventors: Michael Polus, Welser Str. 65; Hans Besendorfer, Friedrichstr. 16, both of 8500 Nürnberg, Fed. Rep. of Germany

[21] Appl. No.: 29,815

[22] Filed: Mar. 25, 1987

[30] Foreign Application Priority Data

Apr. 18, 1986 [DE] Fed. Rep. of Germany ..... 3613153

[51] Int. Cl.[4] ..... A43B 21/28; A43B 13/20; A43B 7/06

[52] U.S. Cl. ..... 36/29; 36/3 B; 36/35 B

[58] Field of Search ..... 36/29, 35 B, 28, 35 R, 36/3 B

[56] References Cited

U.S. PATENT DOCUMENTS

| | | | |
|---|---|---|---|
| 1,506,975 | 9/1924 | Cooney | 36/28 X |
| 1,568,405 | 1/1926 | Keller | 36/29 X |
| 2,122,108 | 6/1938 | Modlin | 36/35 B X |
| 3,050,875 | 8/1962 | Robbins | 36/3 B |
| 3,670,429 | 6/1972 | Androsiglio | 36/3 B |
| 4,102,061 | 7/1978 | Saaristo | 36/28 |
| 4,237,625 | 12/1980 | Cole et al. | 36/28 |
| 4,358,902 | 11/1982 | Cole et al. | 36/29 X |
| 4,361,969 | 12/1982 | Vermonet | 36/29 X |
| 4,546,555 | 10/1985 | Spademan | 36/29 X |
| 4,674,200 | 6/1987 | Sing | 36/29 X |

FOREIGN PATENT DOCUMENTS

| | | | |
|---|---|---|---|
| 82/00571 | 3/1982 | PCT Int'l Appl. | 36/29 |
| 2039717 | 8/1980 | United Kingdom | 36/29 |

*Primary Examiner*—John Petrakes
*Assistant Examiner*—Thomas R. Hannon
*Attorney, Agent, or Firm*—Holman & Stern

[57] ABSTRACT

There is a sports shoe with a sole (4) and an inflating device which is arranged under a convex part of the foot (3) and delimits a compression chamber (16) with a chamber body (1) as well as a chamber roof (14), the compression chamber having an inlet opening (17) and an outlet opening (18). It is desirable to improve the effect of the inflating device by minimizing the clearance space in the compression chamber. This is accomplished by forming the compression chamber (16) as a semi-lentil-shaped (dished) bowl which is conformed to fit the convex contour of the region of the foot (3) loading it and by having the inlet opening (17) as well as the outlet opening (18) arranged in the central area of the chamber (16). Since, on compression, the chamber cover will hug the bottom of the compression chamber, it is possible to produce a positive pressure commensurate with the down-stepping force applied.

7 Claims, 2 Drawing Sheets

SPORT SHOE WITH PNEUMATIC INFLATING DEVICE

Figure 1:
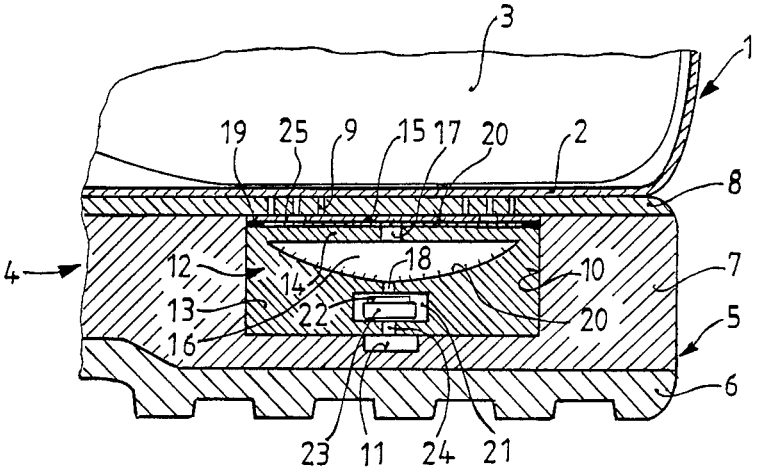

This invention relates to a sports shoe with a sole which is provided with air chambers serving to accept air at a positive pressure and a foot-operated pneumatic inflating device connected thereto and arranged under an area of the sole part of the shoe to be loaded by a convex region of the foot and which, with a chamber body as well as a chamber roof associated with the sole part of the shoe, delimits a compression chamber which is connected via an inlet opening as well as an inlet valve to the outside atmosphere and via an outlet opening as well as an outlet valve to the air chambers.

In a sports shoe of this type disclosed earlier (German Preliminary patent No. 30 31 818), the compression chamber is substantially rectangular in a vertical cross-section. The inlet opening and the outlet opening are arranged in substantially vertical regions of the wall closely under the roof of the chamber. When the inflating device is operated by the roof and the body of the chamber being pressed against each other and the volume of the compression chamber is reduced thereby, a relatively large clearance volume will remain even when a high pressure is exerted. This remaining clearance volume detracts from the performance of the inflating device because it permits only relatively low pressures to be attained. Because of the inevitably large remaining clearance volume, a relatively large height of the compression chamber has to be adopted, i.e. a long stroke of the inflating device which involves disadvantages in using the sports shoe.

It is therefore an object of the invention to provide a sports shoe of the type initially referred to where the effect of the inflating device is improved with the clearance volume in the compression chamber being minimized. In accomplishing this task, the sports shoe according to the invention is characterized in that the compression chamber is formed as a semi-lentil-shaped (dished) bowl conformed to fit the convex contour of the region of the foot loading it and in that the inlet opening as well as the outlet opening are arranged in the central region of the compression chamber.

Thanks to the dished shape of the compression chamber, the clearance volume is minimized when the compression chamber is compressed because the roof of the chamber hugs the bottom of the compression chamber. This makes it possible for a pneumatic positive pressure to be produced commensurate with the down-stepping force applied. Although the stroke is reduced, inflation of the air chambers improved. The volume of the compression chamber can be reduced, whereby the characteristics of the sports shoe for the wearer are improved. Since the vertical cross-section of the compression chamber decreases towards its edge, the inlet opening and outlet opening are arranged in the region of the centre in order that they are not obstructed by the walls of the chamber when the chamber is closely compressed. The inflating device is arranged with the inlet opening and the outlet opening located substantially at the "zenith" of the convexity of the region of the foot applying the load, which, as a rule, is the heel of the foot.

The compression chamber bowl need not be absolutely circular in the horizontal cross-section although normally it would be. It is specially effective and advantageous for the compression chamber bowl to have a ratio of its diameter to its height between 5:1 and 12:1 which illustrates the flatness of the compression chamber of the sports shoe according to the invention. In practice, the height at the centre would be of the order of 5–7 mm and the maxiumum diameter, e.g. the top diameter at the roof of the chamber, of the order of 27–37 mm.

The inflating device will normally produce pressures of 0.28–1.4 atm (=atmospheres gauge), with pressures as high as 2.4–2.8 atm being produced in jumping. These are the pressures for which the inflating device is proportioned. The dimensioning of the inflating device and, respectively, the sports shoe is matched to the average values of the ordinary user. Thanks to the dished compression chamber bowl the inflating device according to the invention also provides an improved support for the heel of the foot. There is continuously some slight unloading of the air chambers in the sole of the shoe because these are not hermetically tight to the outside.

As a rule, the inlet valve will be arranged close to the inlet opening in order to avoid a channel between the inlet opening and the inlet valve. It is specially effective and advantageous also if the outlet valve is arranged close to the outlet opening because this will also avoid (ineffective) clearance space.

Furthermore, it is specially effective and advantageous if the inlet valve and/or the outlet valve are arranged in a vertical direction above the inlet opening or, respectively, below the outlet opening. This arrangement follows when all dead space between the opening and the valve is avoided and is made possible because due to the extremely shallow compression chamber, there is sufficient space available in the vertical direction for the valves.

In constructing the inlet valve and the outlet valve, rigid parts and fixed connections of parts of the valves with other parts of the inflating device and/or the sole should be avoided because this would be liable to cause defects, considering the flexibility of the material of the sole. The parts of the valves should be matched to the other parts of the sole and the inflating device also in respect of the shrinkage of the material.

It is therefore specially effective and advantageous if, in the case of the outlet valve, the valve element is made as a thin flexible plastic disc and/or, in the case of the inlet valve, a valve lamella, which is sealingly attached around its edge, rests loosely but sealingly on the sealing surface to close holes arranged with lateral spacing.

These valves are of exceptionally shallow construction and therefore specially suited for use above and below the compression chamber. The valve disc is made of plastic and air-tight. An elastic block of foam material due to its resilience on compression forms an air-permeable spring element and serves as a compression spring. A centre region of the valve lamella, for instance, covers the inlet opening on a load being applied by the foot of the wearer. The return motion of the valve lamella is produced by its own elasticity assisted by the restoring elasticity of the inflating device. The holes in the sole are, as a rule, formed as fine perforations.

It is also specially effective and advantageous if at least one of the surfaces of the roof and body of the chamber which contact each other when the compression chamber is fully compressed is studded with small elastically compressible projections and/or if at least one of the surfaces of the valve lamella and the chamber roof which contact each other when the inflating device is loaded is studded with small elastically compressible projections. These projections of, say, 0.2 mm thickness will prevent sticking and assist separation of the allied surfaces and, thereby, accelerate the action of the valves.

A specially effective and advantageous embodiment of the invention provides for the inflating device to be an integral unit which embraces the chamber body, the chamber roof, the inlet valve and the outlet valve and is inserted in a cut-out in the sole of the shoe. Due to the construction of the compression chamber in accordance with the invention, production of the chamber body and the chamber roof is more complex. This can be compensated by and largely by (the benefits of) an integral unit. The integral unit also simplifies the integration of the valves. It is possible to make the chamber body and the chamber roof together from a plastic which is somewhat different from the plastic of the sole of the shoe, especially as the chamber roof has a function similar to that of a pump diaphragm and is somewhat dilatable. The inflating device and, respectively, its parts, may consist for instance of a silicone rubber.

A specially effective and advantageous embodiment of the invention provides for the inlet opening to be arranged at the side of the outlet opening and for the valve lamella of the inlet valve as well as the valve disc of the outlet valve to be arranged on opposite sides of the same chamber housing region. This simplifies the construction of the inflating device, the inlet valve is arranged in a more protected manner and the lateral admission of air is simplified.

The prior-art sports shoe referred to initially has air chambers extending over substantially the whole sole and formed with square sides in the horizontal cross-section with relatively narrow walls separating them from each other. The strength of this sole against bending and tension in the horizontal direction is relatively small. The large hollow spaces extending over a considerable area also present a relatively large volume that has to be inflated and kept inflated by the inflating device. This causes difficulties if the designer desires to accomplish his objective with the least possible volume of the compression chamber.

Another object of the invention is therefore to provide a sports shoe with a sole where the air chambers are improved in respect of their form and distribution. In attaining this object, a sports shoe according to the invention is characterized in that the air chambers are limited to regions of the sole which are primarily loaded by the foot and formed as individual hollow spaces which are rounded in the horizontal plane and are interconnected by channels which are open throughout.

By limiting the air chamber to the regions of the heel, the outer border of the arch and the metatarsus/ball region of the foot, the area of the sole taken up by air chambers is reduced without the desired spring and damping properties being appreciably affected. Due to the reduction (of the area where air chambers are provided), the strength of the sole is improved, a decisive contribution being the rounded shape of the air chambers which may, for instance, be elliptical. There is also a reduction in the total air chamber volume which is why the air chamber configuration according to the invention in conjunction with the inflating device configuration according to the invention is of special advantage, the inflating device according to the invention permitting high pressures with a small volume of the compression chamber.

Preferred embodiments of the invention are illustrated in the drawing in which

Figure 2:
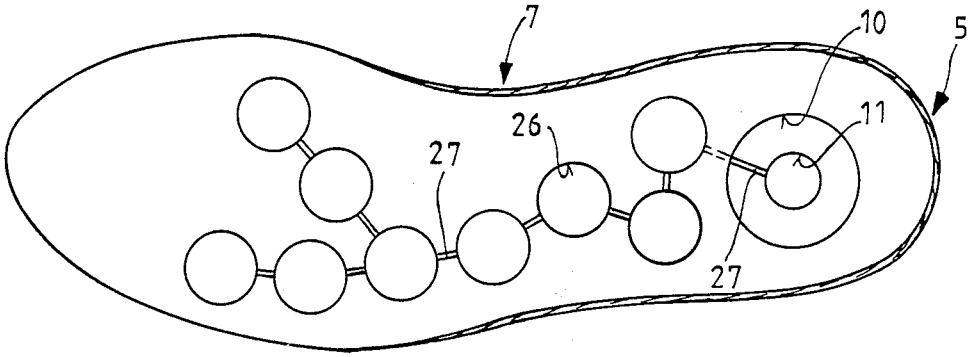
Figure 3:
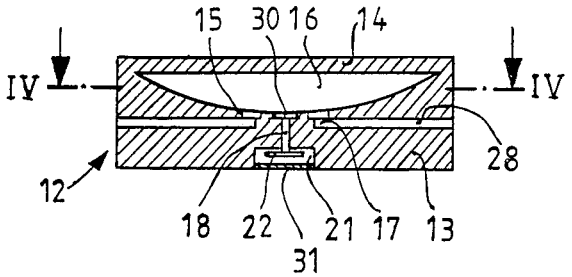
Figure 4:
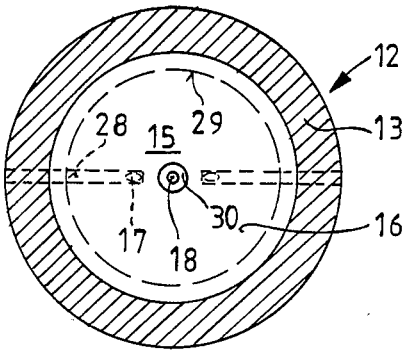

FIG. 1 is a vertical section through part of a sports shoe with a pneumatic inflating device, FIG. 2 a plan view of part of the sole of the sports shoe according to FIG. 2, FIG. 3 a vertical section through another pneumatic inflating device of a sports shoe and FIG. 4 a section along the line IV—IV in FIG. 3.

The sports shoe according to FIG. 1 includes an upper shoe (1) whose sole part (2) is air-permeable in the heel region in a manner not shown in detail. The sole part may, for instance, be provided with crossed slots in the heel region in order to obtain air permeability and pliability. The upper shoe (1) accommodates a foot whose heel (3) is shown schematically and which is ball-shaped downwards. The upper shoe (1) is fastened to a sole (4) whose heel (5) is shown in FIG. 1 and located under the heel (3) of the foot.

The sole (4) comprises a profiled layer (6) at the bottom, on this a core layer (7) and on the latter a top layer (8) which is very much thinner than the core layer (7). The profiled layer (6) consists of a relatively firm solid plastic which is little compressible. The core layer (7) and the top layer (8) each consist of the same material, namely, an elastically compressible foamed plastic. The sole or, respectively, the sum of the core layer and the top layer, is thicker in the heel region than in the other part of the sole. In the region of the heel (5) of the shoe under the heel (3) of the foot and the air-permeable region of the sole part (2), the top layer (8) is provided with holes (9) formed as fine perforations, the hole being spaced horizontally from a center.

In the region of these holes (9), a circular cutout (10) is provided in the heel (5) of the shoe and specifically in the core layer (7), the cutout being circular in the horizontal cross section, closed at the bottom and open towards the top layer (8). The cutout (10) continues downwards at the centre into a small recess (11) and accommodates an inserted integral unit (12) on which the top layer (8) rests loosely without any bonding. The integral unit (12) comprises a chamber body (13), a chamber roof (14) and a valve lamella (15), which is also solid at the center, which are each made of silicone rubber, the valve lamella resting tightly but loosely on the chamber roof (14) and being bonded to the chamber roof (14) around its circumferential edge (19).

The chamber body (13) and the chamber roof (14) form a chamber housing, are made in one piece and delimit a compression chamber (16) which is of semi-lentil or dished shape and, in this case, is dished or concave at the bottom. The chamber roof (14) which represents a kind of pump diaphragm, is provided at the center with an inlet opening (17) and, below this, the chamber body is formed at the center with an outlet opening (18). The chamber roof (14) is formed at the side facing the valve lamella (15) with small elastically compressible projections (20) and one of the two opposed surfaces of the compression chamber (16) is also provided with such projections (20), these projections being integral with the chamber cover or, respectively, the chamber body.

The outlet opening (18) communicates with a cavity (21) which is provided in the chamber body (13) and accommodates a valve disc (22) arranged under the outlet opening, the valve disc being loaded from below by a spring block (23) made of foam material. The cavity (21) is connected downwards via a hole (24) with the small recess (11). If the inflating device does not work, the valve disc (22) is sealingly pressed against the outlet opening (18) due to the loading by the spring block (23) and the atmospheric pressure which acts from the small recess (11).

When a load is applied to the inflating device, the pressure acting on the valve lamella (15) closes the inlet opening (17) and the compression chamber (16) is compressed. As soon as the pressure in the compression chamber (16) is high enough, the valve disc (22) is pushed downwards and air will flow through the outlet opening (18) to the small recess (11). On unloading, the valve disc (22) closes the outlet opening (18) and air is sucked in through the holes (9), the holes (25) of the valve lamella (15) and the central inlet opening (17) into the compression chamber. On unloading, the elastic restoring force of the chamber body, the chamber roof and the valve lamella takes effect.

According to FIG. 2, the cutout (10) provided with the small recess (11) is located in the core layer (7) and, specifically, in the region of the heel (5) of the shoe. The core layer (7) of the sole of the shoe is provided, in the regions where the load of the wearer of the shoe is primarily applied, with air chambers (26) which, in this case, are circular and formed with a diameter smaller than that of the cutout (10). The air chambers(26) which are closed at the bottom and open at the top are formed with a constant cross section over their height. The air chambers are connected with each other and with the recess (11) by small narrow channels (27) in series. The air chambers (26) are of equal size and the channels (27) extend only over a fraction of the height of the air chambers. The length of a channel between two adjacent air chambers is smaller than the diameter of the air chambers.

In the configuration shown in FIGS. 3 and 4, the inflating device is also constructed as an integral unit (12). As a deviation from the configuration according to FIG. 1, the chamber roof (14) is solid throughout, i.e. without any holes and, at the side of the central outlet opening (18) but still in the central region of the bowl close to the outlet opening (2) there are inlet openings (17). Each inlet opening is located at the inner end of a channel (28) which leads in the compression chamber body (13) radially outwards. The valve lamella (15) forms the dished bottom of the compression chamber (16) and is detached from the remaining chamber body from the center radially outwards up to a dash-line circle (29). Above the outlet opening (18), the valve lamella is formed with a hole (30) and its thickness increases radially outwards. Between the hole (30) and the outlet openings (17) there is an area in each case where the valve lamella (15) sealingly bears on the valve body (13).

When the inflating device is unloaded and the compression chamber (16) draws in air, the valve lamella (15) will be lifted so that air can flow through the channel (28) and the hole (30) into the compression chamber (16). The valve lamella (15) is very thin where it has a sealing function and where it covers the channel (28) it is thicker and therefore stiffer.

If a pumping pressure exists in the compression chamber (16), the valve lamella is pressed against the chamber body in the sealing region whereby the connection between the compression chamber and the channel (28) is blocked. The cavity (21) is shut off by a perforated diaphragm (31) downwards and the valve disc operates without any separate compression spring.

We claim:

1. Sports shoe with a sole which is provided with air chambers serving to accept air at a positive pressure and a foot-operated pneumatic inflating device connected thereto and arranged under an area under a part of the sole to be loaded by a convex region of the foot and with a chamber body as well as a chamber roof associated with the sole parts of the shoe delimits a compression chamber which is connected via an inlet opening as well as an inlet valve to the outside atmosphere and via an outlet opening as well as an outlet valve to said chambers, characterized in that the inflating device is an integral unit which includes the chamber body, the chamber roof, the inlet valve and the outlet valve, the unit being inserted in a cut-out in the sole of the shoe, further characterized in that the compression chamber is formed as a dished bowl conformed to fit the convex contour of the region of the foot loading it and in that the inlet opening as well as the outlet opening are arranged in the central region of the chamber, the oulet valve having a valve body formed as a thin flexible disc positioned under the outlet opening, the disc being received in a cavity in said unit with an underlying spring block, and the inlet valve comprising a valve lamella which rests against and covers the inlet opening.

2. Sports shoe as in claim 1, characterized in that the compression chamber bowl has a ratio of its diameter to its height between 5:1 and 12:1.

3. Sports shoe as in claim 1, characterized in that said valve lamella, is sealingly attached around its edge to the chamber roof.

4. Sports shoe as in claim 3, characterized in that at least one of the surfaces of the valve lamella and the chamber roof which contact each other when the inflating device is loaded is studded with small elastically compressible projections.

5. Sports shoe as in claim 1, characterized in that at least one of the surfaces of the roof and body of the chamber which contact each other when the compression chamber is fully compressed is studded with small elastically compressible projections.

6. Sports shoe as in claim 1, characterized in that the inlet opening is arranged at the side of the outlet opening and the valve lamella of the inlet valve as well as the valve disc of the outlet valve are arranged on opposite sides of the same chamber housing region.

7. Sports shoe as in claim 1, characterized in that the air chambers are limited to regions of the sole of the shoe which are primarily loaded by the foot and are formed as individual hollow spaces which are rounded in the horizontal plane and are interconnected by channels which are open throughout.

* * * * *